US005144327A

United States Patent [19]

Chekroun et al.

[11] Patent Number: 5,144,327

[45] Date of Patent: Sep. 1, 1992

[54] SOURCE OF MICROWAVE RADIATION FOR AN ELECTRONIC SWEEPING ANTENNA WHICH ABSORBS REFLECTED ENERGY

[75] Inventors: Claude Chekroun, Gif S/Yvette; Gérard Collignon, Limours, both of France

[73] Assignee: Thomson-CSF Radant, Cedex, France

[21] Appl. No.: 625,480

[22] Filed: Dec. 11, 1990

[30] Foreign Application Priority Data

Dec. 26, 1989 [FR] France ..... 89 17170

[51] Int. Cl.[5] ..... H01Q 11/04; H01Q 3/460

[52] U.S. Cl. ..... 343/731; 343/754

[58] Field of Search ..... 343/731, 739, 767, 770, 343/771, 789, 909, 753, 754, 732-738

[56] References Cited

U.S. PATENT DOCUMENTS

| | | | |
|---|---|---|---|
| 1,992,283 | 2/1935 | Bailey et al. | 343/731 |
| 4,212,014 | 3/1982 | Chekroun | 343/754 |
| 4,297,708 | 10/1981 | Vidal | 343/754 |
| 4,320,404 | 5/1982 | Chekroun | 343/854 |
| 4,344,077 | 8/1982 | Chekroun et al. | 343/754 |
| 4,433,313 | 2/1984 | Saint et al. | 333/109 |
| 4,447,815 | 5/1984 | Chekroun et al. | 343/754 |
| 4,975,712 | 12/1990 | Chen | 343/753 |
| 5,001,495 | 3/1991 | Chekrovn | 343/754 |

FOREIGN PATENT DOCUMENTS

| | | |
|---|---|---|
| 2549300 | 1/1985 | France . |
| 2629920 | 10/1989 | France . |
| 0208307 | 8/1988 | Japan . |

OTHER PUBLICATIONS

Rotman et al., The Sandwich Wire Antenna: A New Type of Microwave Line Source Radiator, I.R.E. National Convention Record, Part I, Mar. 18-21, 1957, pp. 166-172.

Hall, et al., "Survey of Design Techniques for Flat Profile Microwave Antennas and Arrays," Radio and Electronic Engineer, vol. 48, No. 11, Nov., 1978, pp. 549-565.

*Primary Examiner*—Michael C. Wimer
*Assistant Examiner*—Peter T. Brown
*Attorney, Agent, or Firm*—Pollock, VandeSande & Priddy

[57] ABSTRACT

Disclosed is a source of microwave radiation, namely a source enabling the absorption of multiple reflections for the illuminating of a lens in order to form an electronic sweeping antenna. The source includes a layered arrangement of elementary illuminators in a direction substantially parallel to the electrical field of the microwave energy transmitted. In one embodiment, each elementary illuminator has the following successively, in the direction of propagation of the energy: a plane forming a short circuit; a plane forming an incidence filter, parallel to the above plane, located at a distance from the above plane of the order of half of a wavelength, including two tracks parallel to each other and perpendicular to the electrical field between which resistive elements are connected; and, a plane bearing a rdiating element of the snake line type, extending in a direction substantially normal to the electrical field. The illuminator and the filter are such that the filter at least partially absorbs the microwave energy received with a non-zero angle of incidence.

6 Claims, 3 Drawing Sheets

FIG.2b
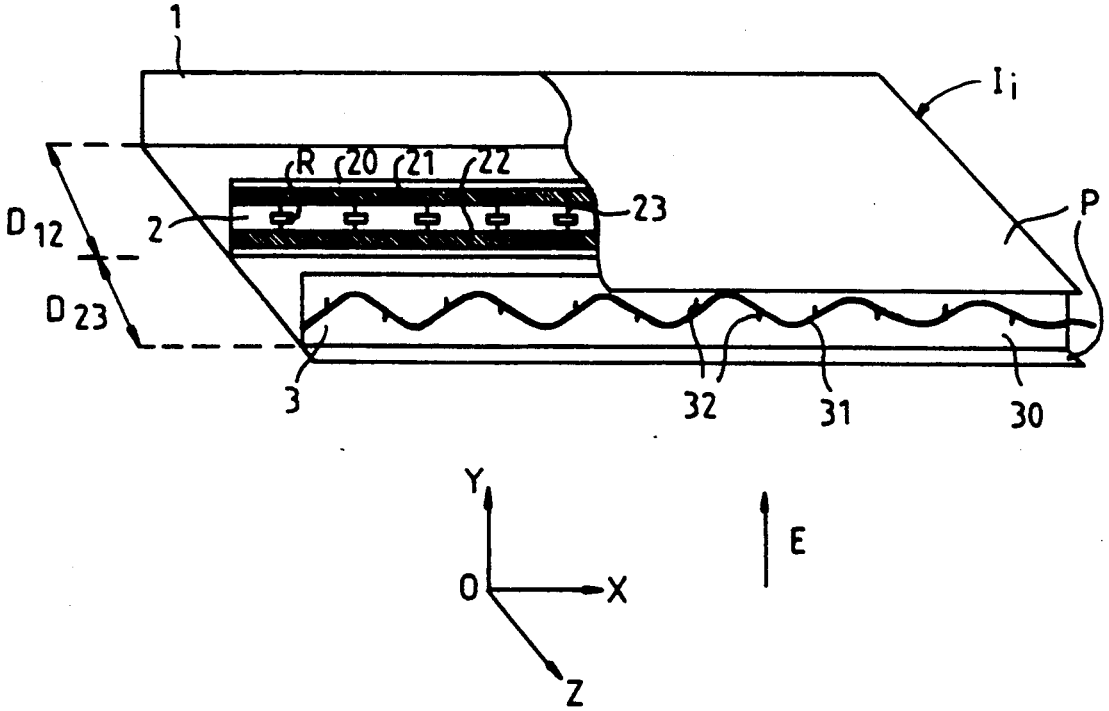
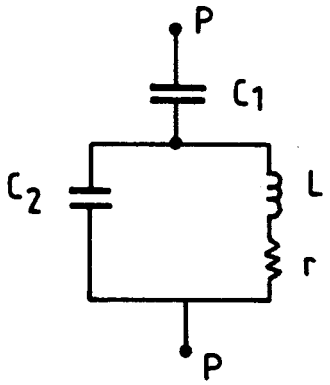
FIG.2c

SOURCE OF MICROWAVE RADIATION FOR AN ELECTRONIC SWEEPING ANTENNA WHICH ABSORBS REFLECTED ENERGY

BACKGROUND OF THE INVENTION

1. Field of the Invention

An object of the present invention is a so-called magic source of radiation, and its application to the illumination of an active lens to form an electronic sweeping antenna.

2. Description of the Prior Art

In an electronic sweeping antenna formed in this way, there is the possibility of certain unwanted phenomena of multiple reflections at the interfaces. These reflections increase the level of the secondary lobes or of the scattered radiation. To get rid of these multiple reflections, it is possible to absorb the reflected energy in the antenna itself, before it is re-transmitted. To this end, in there is the known method wherein the division of power necessary for the supply of each radiating element of the antenna is achieved by using a large number of directional couplers absorbing the reflected energy. This type of structure, however, has the drawback of being complicated, difficult to design and construct, and costly.

SUMMARY OF THE INVENTION

An object of the present invention is a radiation source that at least partly absorbs rays reflected by the lens, whatever the angle of incidence of this radiation when it is outside the main lobe of the antenna. This is what is meant, in the present invention, by magic source, by analogy with the microwave junctions known as magic-T junctions.

To this effect, the source according to the invention has a layered arrangement of channels made in a direction substantially parallel to the electrical field of the microwave energy transmitted. Each channel has the following elements, successively in the direction of propagation of energy, each positioned perpendicularly to it:

- a plane forming a short-circuit;
- a plane forming an incidence filter, located at a distance, from the above plane, of the order of half a wavelength of the radiated energy, said filter including resistive means;
- a plane bearing a microwave illuminator of the snake line type, the snake line extending in a direction perpendicular to the electrical field.

The illuminator and the filter are such that the filter at least partially absorbs the microwave energy received with a non-zero angle of incidence.

DESCRIPTION OF THE FIGURES

Other objects, special features and results of the invention will emerge from the following description, given as a non-restrictive example and illustrated by the appended drawings, of which:

FIGS. 2*a* and 2*b* show different embodiments of an element of the source according to the invention, and FIG. 2*c* shows an explanatory drawing of FIG. 2*b;*

In these different figures, the same reference numerals pertain to the same elements.

Besides, throughout the following description, the working of the device according to the invention is described in transmission mode but, of course, in symmetrical fashion, this device works in reception mode too.

DESCRIPTION OF PREFERRED EMBODIMENTS

Figure 1:
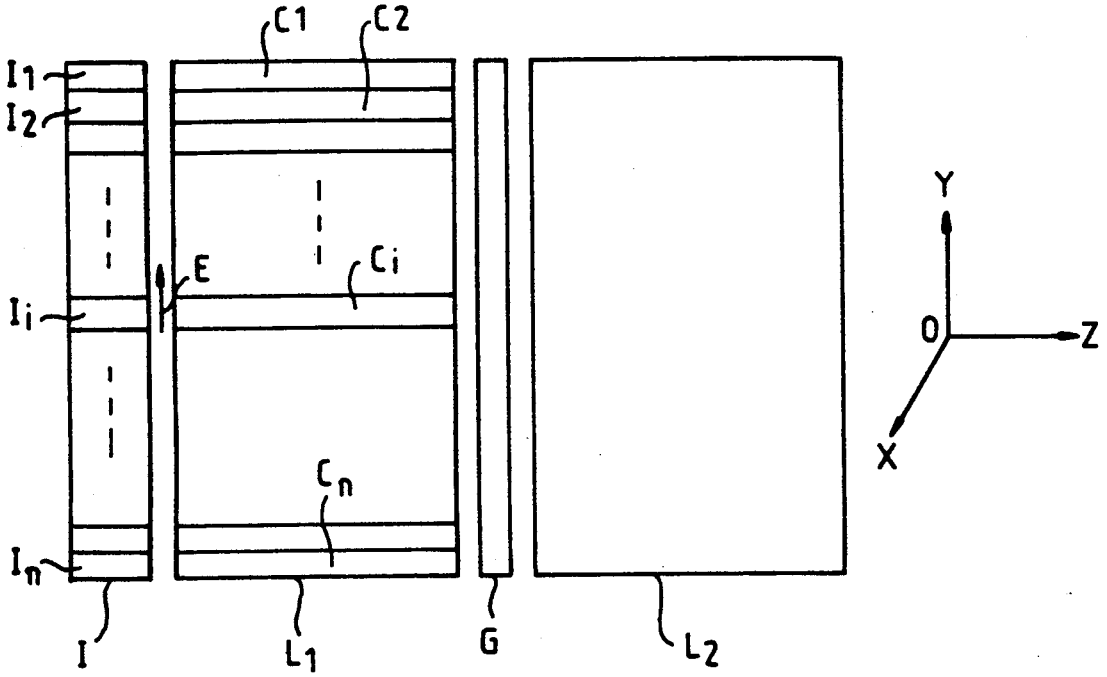
FIG. 1 shows a drawing of an antenna with electronic sweeping along two perpendicular planes, using the source according to the invention.

FIG. 1 therefore shows the drawing of an embodiment of a two-plane electronic sweeping antenna using the source according to the invention.

The antenna has a microwave radiation source, also called an illuminator and referenced I, providing an electromagnetic wave that gets propagated along a direction OZ and has its electrical field E directed along a direction OY, perpendicular to the previous direction The following are positioned successively in the path of the electromagnetic wave: a first microwave lens $L_1$, a grid G providing for the rotation of the polarization of the wave and, then, a second microwave lens $L_2$.

In this embodiment, the illuminator I consists of a layered arrangement of elementary illuminators, referenced $I_1$, $I_2$..., $I_i$ ... $I_n$, the layered arrangement being done along the axis OY.

Similarly, the lens $L_1$ has a layered arrangement of channels referenced $C_1$, $C_2$ ... $C_i$ ... $C_n$ made along the axis OY. Each of these channels has electronically controllable phase-shifter means. Thus, by variation in the phase-shifting values, it is possible to obtain an electronic sweeping by the beam given by the illuminator I in the plane of the field E, namely the plane YOZ. An embodiment of such a lens is described, for example, in the French patent No. 2 469 808. In one preferred embodiment, the illuminator may be integrated into the lens $L_1$, as described in the French patent application No. 84 11066.

To further obtain electronic sweeping in the perpendicular plane, namely in a plane XOZ, the axis OX being perpendicular to the axes OY and OZ, a second lens $L_2$ is added according to this embodiment. This lens is of the same type as the lens $L_1$, but is one in which the layered arrangement of the channels is intersected with the previous layered arrangement, i.e. it is made along the axis OX. The rotation polarization grid G is designed so that the electrical field E is always perpendicular to the layered arrangement of the channels.

Figure 2A:
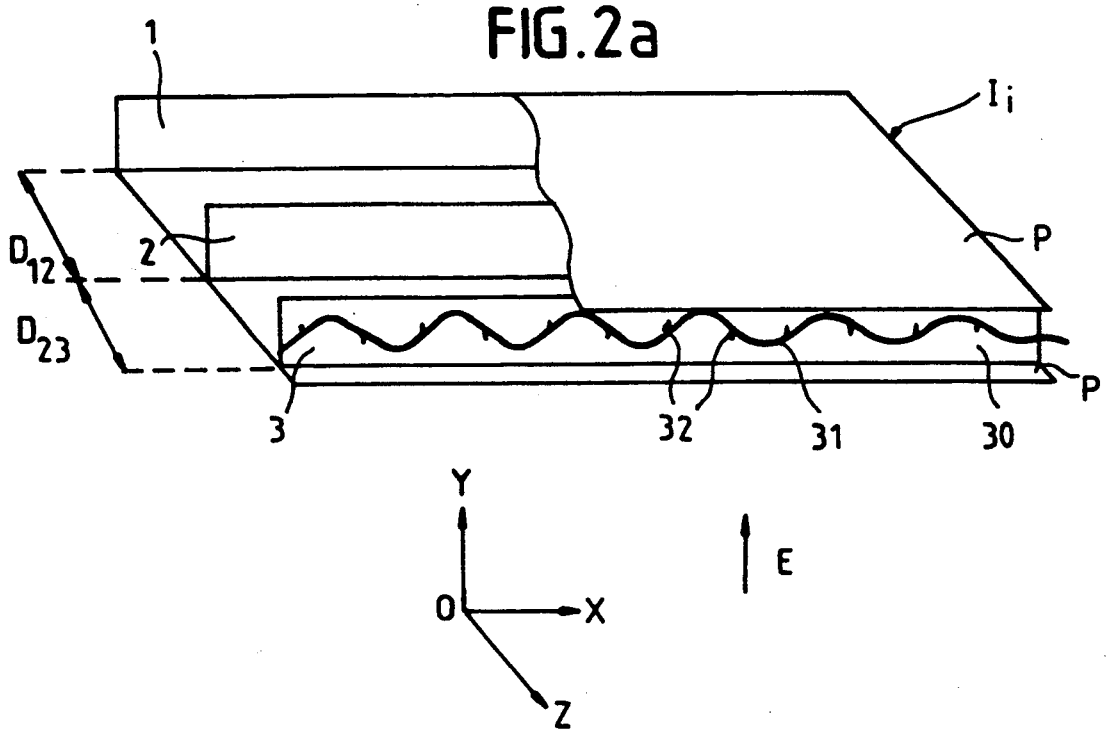

FIG. 2*a* shows an embodiment of an elementary illuminator, referenced $I_i$, of the layered arrangement forming the illuminator I of the previous figure.

This elementary illuminator consists of the following, positioned successively in the direction OZ:

- a first conductive plane 1, forming a short-circuit, substantially parallel to the plane XOY;
- a second plane 2, also positioned substantially along the plane XOY, forming an incidence filter and referenced 2;
- a third plane 3, again substantially parallel to the plane XOY and bearing a radiating element.

The assembly is positioned between two conductive planes P, substantially parallel to the plane XOZ.

The radiating element is, for example, of the snake line type. It is formed by a conductive deposit 31 on an insulator substrate 30 in a pseudo-sinusoidal shape extending substantially in the direction OX. Capacitive elements 32, also known as "stubs" are positioned at regular intervals on either side of the conductive line 31. These stubs are intended for the impedance matching of the plane 3.

In this embodiment, the plane 2 forming an incidence filter is formed by an insulator substrate, covered substantially throughout its surface by a resistive layer.

The plane 2 is separated from the planes 1 and 2 respectively by distances $D_{12}$ and $D_{23}$.

The distance $D_{12}$ is chosen so as to be in the range of half a wavelength ($\lambda_o$) of operation of the illuminator, at normal incidence (angle of incidence in relation to the axis OZ: $\theta=0$).

The distance $D_{23}$, as well as the parameters of the radiating element, are determined so that the illuminator is matched for the incidence angles that correspond to the main lobe of the radiating element. It may be recalled that, in the case of a snake line, the parameters are the amplitude of the pseudo-sinusoid formed by the snake line, the half-period of the sinusoid, and the position and the length of the stubs.

For a wave at normal incidence ($\theta$:0), the distance $D_{12}$ being equal to $\lambda_o/2$, a short-circuit is brought into the plane 2 of the incidence filter, irrespective of the constitution of this filter: this filter i therefore transparent and introduces no losses.

For the incidence values different from those that correspond to the main lobe, the snake line is transparent and the coefficient of reflection of the antenna is that of the plane 2 of the incidence filter.

As is known, at an angle of incidence $\theta$, the wavelength becomes $\lambda(\theta) = \lambda_o/\cos\theta$. For $\theta=\pi/3$, it is seen that the distance $D_{12}$ becomes equal to $\lambda/4$, thus setting up a open circuit in parallel with the plane 2 forming the incidence filter. For this angle of incidence, the wave is therefore totally absorbed in the resistive plane 2, this absorption decreasing as we move away from the angle of incidence $\theta=\pi/3$.

It is thus seen that a wave transmitted by the illuminator and subsequently reflected by one of the interfaces of the antenna is absorbed by the illuminator, thus preventing unwanted lobes at the output of the antenna.

FIG. 2*b* shows a variant of FIG. 2*a*, relating the embodiment of the plane 2.

The plane 2, forming an incidence filter, is constituted by an insulator substrate 20 bearing resistive elements R. These resistive elements are connected by connections 23 to two conductors, or tracks, 21 and 22, extending in a direction substantially parallel to the axis OX. The resistive elements R may be resistors or diodes.

FIG. 2*c* shows the equivalent circuit diagram of the plane 2 of FIG. 2*b*.

This diagram includes, between two planes P, two capacitors $C_1$ and $C_2$ in series. An inductor L and a resistor r are connected in series to the terminals of the capacitor $C_2$.

This alternative embodiment, which adds an imaginary part (inductive and capacitive) to the impedance introduced by the plane 2, makes it possible, by action on the parameters of the incidence filter formed by the plane 2, to obtain the matching of this filter and, hence, the absorption of the reflected waves, for an incidence other than $\theta=\pi/3$. The parameters of the filter are the distance between the tracks 21 and 22 (capacitor $C_2$), the position of the tracks 21 or 22 with respect to the planes P (capacitor $C_1$), the value of the resistors R and the length of the connections 23 (inductor L and resistor r).

When the resistive elements R are formed by diodes, the variation in the polarization current of the diodes enables the preceding parameters to be made to vary to order, and hence enables the absorption of the reflected waves for angles of incidence with a value that is thus adjustable electronically.

Figure 3:
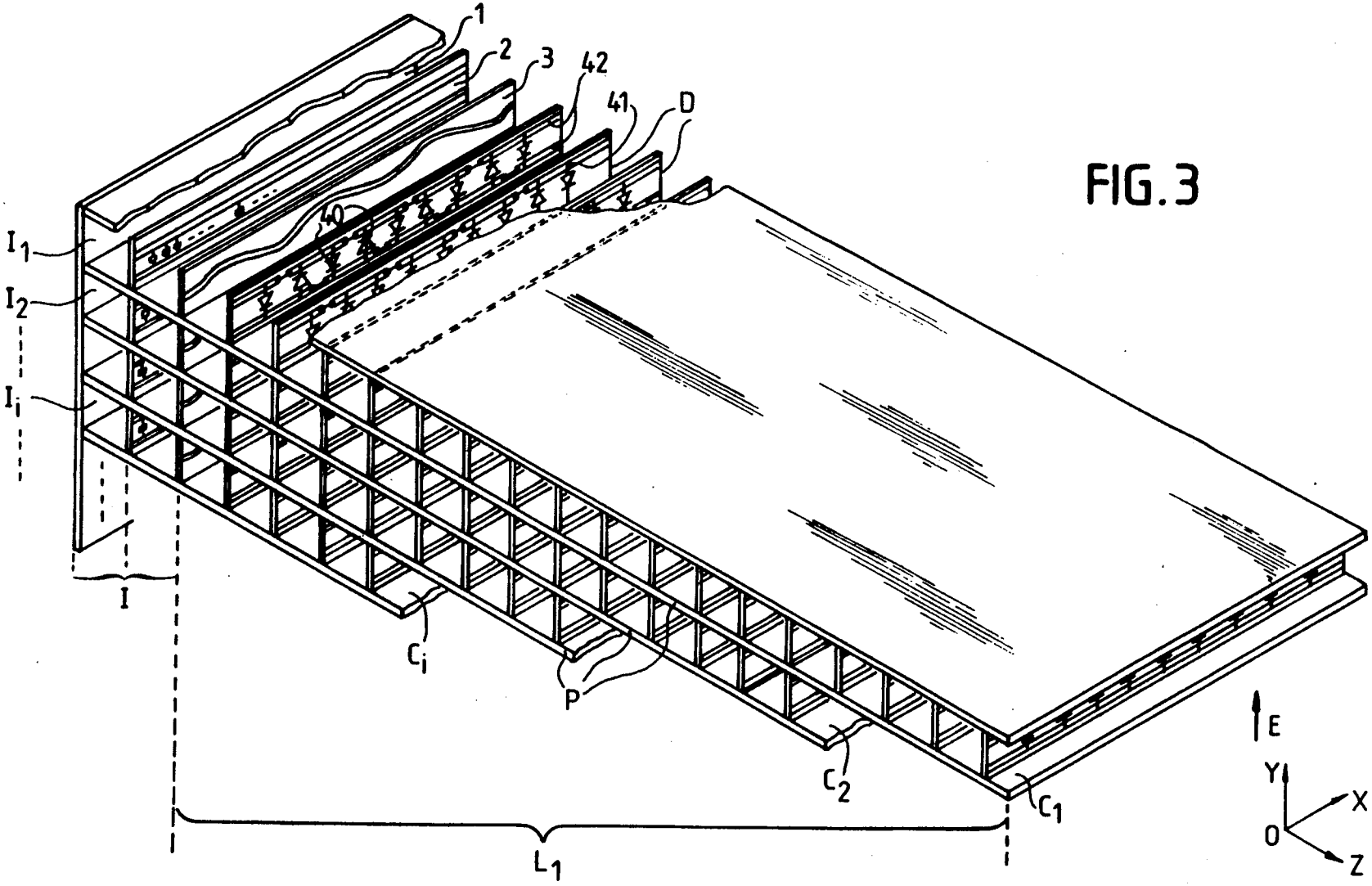
FIG. 3 shows an embodiment of an electronic sweeping antenna integrating the source according to the invention.

FIG. 3 shows an embodiment of an illuminator I according to the invention, integrated with the lens $L_1$.

This figure again shows the three planes 1, 2 and 3 of FIG. 2, extending along the plane XOY and forming the illuminator I. The device again has the conductive planes P, parallel to the plane XOZ and mutually defining the channels $I_1$, $I_2$...$I_i$,...

According to this embodiment, the conductive planes P are extended to form the channels $C_1$, $C_2$...$C_i$,... of the lens $L_1$. Planes D are positioned in each of the channels C. These planes D are parallel to the plane XOY, each of them bearing electronically controllable phase-shifter means. These phase-shifter means include diodes 40, connected by connections 41, substantially parallel to the axis OY, to conductors 42, substantially parallel to the axis OX. This conductors connect all the diodes of one and the same phase-shifter plane to a controllable bias voltage. Phase-shifter planes of this type, arranged in channels, are described in the above-mentioned French patent No. 2469808.

The electronic sweeping obtained by the control of the phase-shifter planes D takes place in the plane of the field E (YOZ), as described here above.

Of course, as illustrated in FIG. 1, it is possible to position a grid G and a lens $L_2$ behind the lens $L_1$ to obtain electronic sweeping in the plane XOZ.

What is claimed is:

1. A source of microwave radiation for the transmission and reception of microwave radiation along a first direction, the electric field of which is substantially directed along a second direction, normal to the first direction, the source including a plurality of conductive planes appropriately spaced to form channels, said plurality of conductive planes spaced in a direction substantially parallel to the second direction, each channel comprising:

a first conductive plane forming a short-circuit to said microwave radiation, extending substantially in a third direction perpendicular to said first and second directions;

a second plane forming an incidence filter, located at a distance from the first plane of substantially half a wavelength of said microwave radiations aid filter including a resistive means;

a third plane spaced apart and substantially parallel to said second plane, bearing a snake line microwave radiator, the filter at lest partially absorbing microwave radiation which is received with a non-zero angle of incidence.

2. A source according to claim 1, wherein the resistive means on the second plane includes an insulator substrate having a resistive layer on its surface.

3. A source according to claim 1, wherein the resistive means on the second plane includes an insulator substrate bearing two tracks, which are substantially parallel to the third direction and resistive elements connected between the tracks.

4. A source according to claim 3, wherein the resistive elements are resistors.

5. A source according to claim 3, wherein the resistive elements are diodes.

6. A source according to claim 1, wherein each of the channels further has a plurality of phase-shifters positioned adjacent the third plane, each phase-shifter electronically controlling the phase-shift applied to the microwave radiation that goes through them, the source and the plurality of phase-shifters forming an electronic sweeping antenna.

* * * * *